US006266511B1

(12) United States Patent
Murakami et al.

(10) Patent No.: US 6,266,511 B1
(45) Date of Patent: Jul. 24, 2001

(54) IMAGE RECORDING APPARATUS

(75) Inventors: Shinichi Murakami; Fumiaki Yoshida; Ken Kikuchi, all of Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 09/534,633

(22) Filed: Mar. 27, 2000

(30) Foreign Application Priority Data

Mar. 31, 1999 (JP) ..... 11-092381

(51) Int. Cl.[7] ..... G03G 21/00

(52) U.S. Cl. ..... 399/358; 222/DIG. 1; 399/360

(58) Field of Search ..... 399/358, 359, 399/360, 252, 256, 260, 261, 262, 263, 264; 15/256.5, 308; 198/657, 670, 671, 752.1; 222/342, 412, DIG. 1

(56) References Cited

U.S. PATENT DOCUMENTS 5,130,756 * 7/1992 Taniyama ..... 399/358
5,270,785 * 12/1993 Kita et al. ..... 399/261
6,055,405 * 4/2000 Knott et al. ..... 399/358
6,085,062 * 7/2000 Mizuishi et al. ..... 399/358

* cited by examiner

*Primary Examiner*—Arthur T. Grimley
*Assistant Examiner*—Hoan Tran
(74) *Attorney, Agent, or Firm*—Rabin & Champagne, P.C.

(57) ABSTRACT

An image forming apparatus has a waste toner transporting path that includes a substantially vertical first path and a second path. The waste toner falls due to its weight through the first into the second path. A spiral member is in the form of, for example, a coil spring or screw conveyor, and axially extends in the second path and rotates to transport the waste toner along the second path. A resilient agitator is mounted on an inner wall of the first path. The agitator is generally in the shape of a rectangle and has a resilient main body with a first end portion, a second end portion, and an agitating strap that resiliently extends away from the main body. The first end portion is fixedly attached to the inner wall of the first path. When the spiral member rotates, the spiral member slidingly engages the second end portion to cause the second end to move along the second path so that the second end portion finally snaps out of engagement with the spiral member. After the second end portion snaps out of engagement with the spiral member, the second end portion resiliently returns to its original position so that the spiral member again slidingly engages the second end portion as the spiral member rotates. The oscillatory motion of the second end portion of the agitator causes the vibration of the agitating strap, thereby shaking the toner off the first path.

9 Claims, 16 Drawing Sheets

IMAGE RECORDING APPARATUS

BACKGROUND OF THE INVENTION

1. Field of the Invention

The present invention generally relates to an electrophotographic apparatus such as a conventional electrophotographic printer, and more particularly to a waste toner transporting mechanism that transports residual toner collected after transfer operation.

2. Description of the Related Art

With a conventional electrophotographic recording apparatus, a small amount of toner is left on a photoconductive drum after transfer operation. The residual toner on the photoconductive drum is removed by a cleaning blade or the like and is transported into a substantially horizontal waste toner-transporting path. A first screw conveyor in a first waste toner transport path rotates to push the waste toner to a first exit. The first exit communicates with a vertical duct so that the waste toner falls through the first exit into the vertical duct. There is provided a second waste toner transport path at the lower end of the vertical duct. The second waste toner transport path extends substantially horizontal. A second screw conveyor in the second waste toner transport path rotates to push the waste toner to a second exit that communicates with a waste toner reservoir. The waste toner falls due to its weight through the second exit into the waste toner reservoir. A movable member is provided at the second exit and formed with a hole therein and is movable between a closing position and an opening position. The movable member is urged by an urging member toward the closing position.

When a side door of the apparatus is closed, a projection formed on the side door pushes the movable member to the opening position so that the hole becomes aligned with the second exit. Thus, the second exit is opened by the movable member. When the side door is opened, the projection moves out of engagement with the movable member so that the movable member moves to the closing position. Thus, the second exit is completely closed by the movable member.

With the aforementioned conventional construction, the toner falls down through the vertical duct by its weight. The waste toner has lost its fluidity, and may adhere to the inner walls of the vertical portion of the duct and cause clogging of the vertical portion.

Another problem with the aforementioned conventional construction is that there is a limitation on the space in which the urging means is accommodated. This creates design constraints.

SUMMARY OF THE INVENTION

The present invention was made in view of the aforementioned problems.

An object of the invention is to provide a waste toner transporting construction that is simple and free from clogging.

An image forming apparatus has a waste toner transporting path that includes a substantially vertical first path and a second path. The waste toner falls due to its weight through the first into the second path. A spiral member in the form of, for example, a coil spring or screw conveyor, axially extends in the second path and rotates to transport the waste toner along the second path. A resilient agitator is mounted on an inner wall of the first path. The agitator is generally in the shape of a rectangle and has a resilient main body with a first end portion, a second end portion, and an agitating strap that resiliently extends away from the main body. The first end portion is fixedly attached to the inner wall of the first path.

When the spiral member rotates, the spiral member slidingly engages the second end portion to cause the second end portion to move along the second path so that the second end portion finally snaps out of engagement with the spiral member.

After the second end portion snaps out of engagement with the spiral member, the second end portion resiliently returns to its original position so that the spiral member again slidingly engages the second end portion as the spiral member rotates. Thus, the second end portion repeats the aforementioned swinging motion as long as the spiral member continues to rotate.

The agitator may be a substantially rectangular synthetic film and has an incision to define the agitating strap that flexes away from the main body. The agitator may have a pair of flaps instead of the agitating strap, the flaps extending at an angle with the main body and waving as the second end portion snaps out of engagement with the spiral member. The agitator may have a friction member attached to the second end portion. When the shaft rotates, the spiral member slidingly engages the friction member so that the friction between the friction member and the spiral member causes vibration of the agitating strap.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

The present invention will be described in detail with reference to the accompanying drawings.

First embodiment

<Construction>

Figure 1:
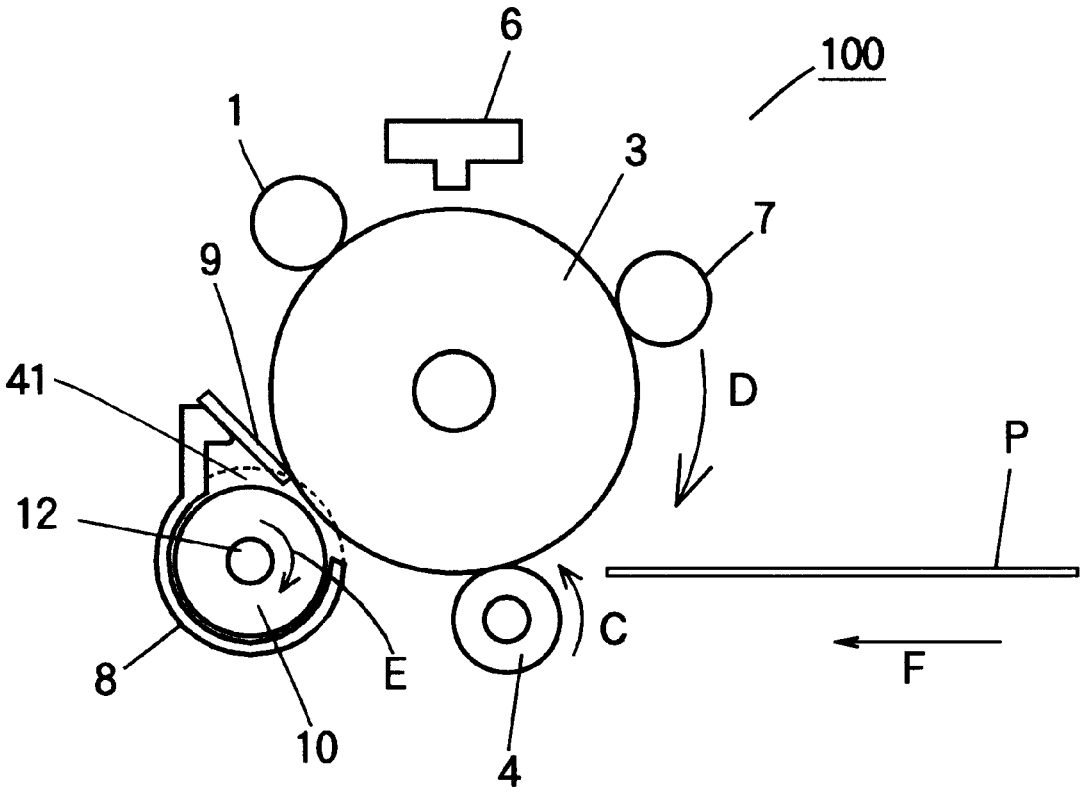
FIG. 1 is a cross-sectional side view of pertinent portion of an image-forming apparatus.

FIG. 1 is a cross-sectional side view of a pertinent portion of an image-recording apparatus.

Referring to FIG. 1, the image-forming cartridge 100 has a photoconductive drum 3. Upon assembling the image forming cartridge 100 into a printer, a charging roller 1, an LED head 6, and a developing roller 7 are positioned around the photoconductive drum 3. The LED head 6 illuminates the surface of the photoconductive drum 3 to form an electrostatic latent image thereon. The developing roller 7 applies toner to the electrostatic latent image to develop the electrostatic latent image into a toner image. A transfer roller 4 rotates in pressure contact with the photoconductive drum 3 so that the transfer roller 4 and photoconductive drum 3 rotate at the same circumferential speed in directions shown by arrows C and D, respectively.

The recording medium P is transported in a direction shown by arrow F by a feeding mechanism, not shown, and pulled in between the transfer roller 4 and the photoconductive drum 3. When the recording medium P passes between the transfer roller and the photoconductive drum 3, the toner image on the photoconductive drum 3 is transferred to the recording medium P.

A cleaning blade 9 extends parallel to the photoconductive drum 3 and is in contact therewith, so that the cleaning blade 9 scratches the surface of the photoconductive drum 3 to remove the residual toner on the photoconductive drum 3.

A waste toner-transporting path 8 supports the cleaning blade 9 and receives the waste toner therein that is scratched by the cleaning blade 9. The waste toner-transporting path 8 communicates with a hollow cylinder 11 (FIG. 2) that projects outwardly from the image-forming cartridge 100.

A screw conveyor 10 that has a spiral blade extends through the path 8 and rotates to transport the waste toner along the path 8 into a cylinder 11. The screw conveyor 10 has a shaft 12 rotatably supported by a longitudinal end of the hollow cylinder 11 and the opposite end of the cartridge 100. The screw conveyor 10 rotates in synchronism with the photoconductive drum 3 in a direction shown by arrow E.

Figure 2:
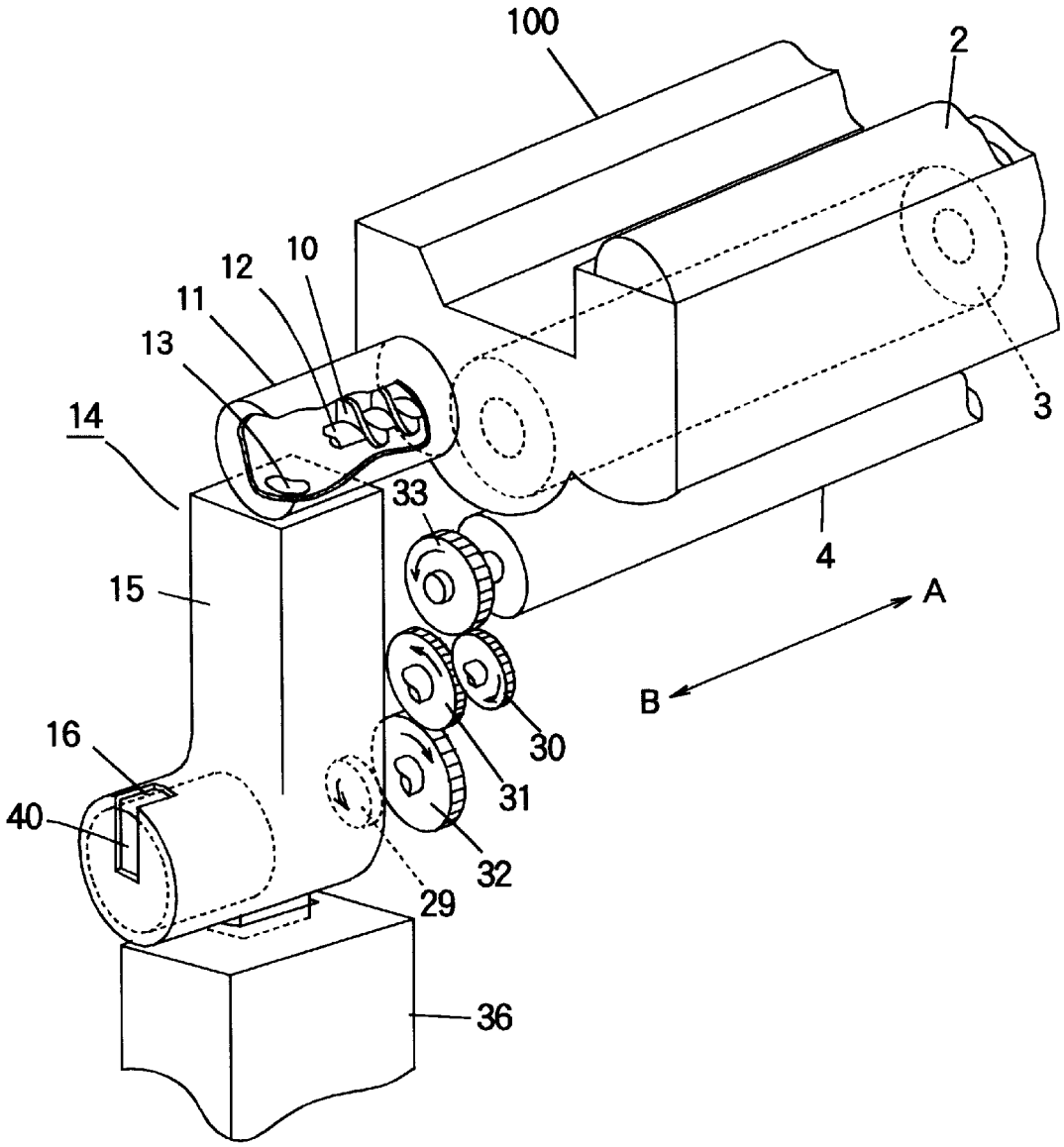
FIG. 2 is a perspective view of an image-recording apparatus according to the present invention, illustrating a pertinent portion of a waste toner transporting mechanism.

FIG. 2 is a perspective view of an image-recording apparatus according to the present invention, illustrating a pertinent portion of a waste toner transporting mechanism.

Referring to FIG. 2, the image-forming cartridge 100 is mounted on a chassis, not shown, and detachably holds a toner cartridge 2 therein. The waste toner removed from the photoconductive drum 3 is conveyed through the cylinder 11. The cylinder 11 has a toner exit 13 formed in its lower circumferential wall. The residual toner is directed through the toner exit 13 into a duct 14 that communicates with the hollow cylinder 11 and extends downwardly.

Figure 3:
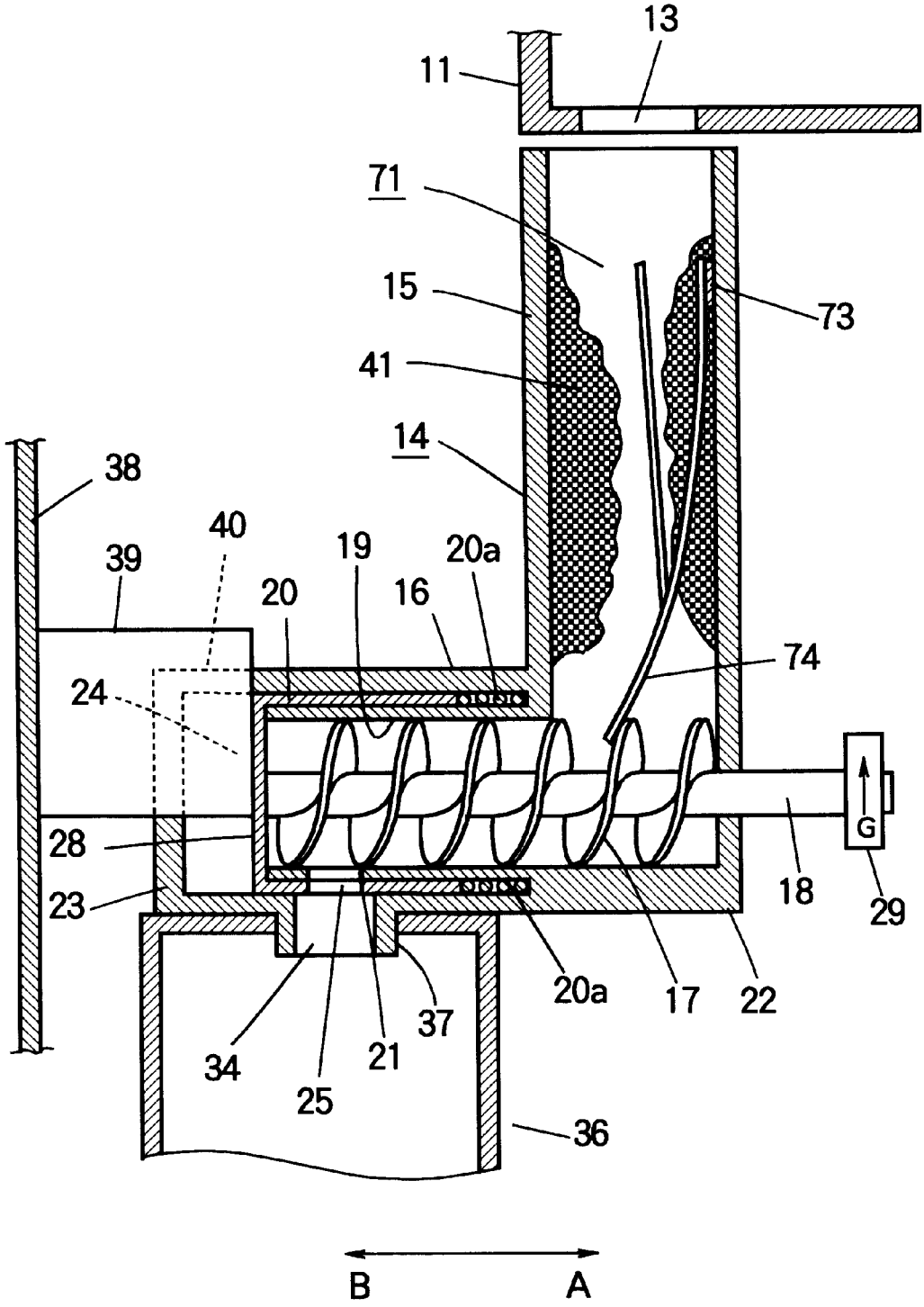
FIGS. 3 and 4 are cross-sectional views showing the interior of a duct of the waste toner transporting mechanism.

FIG. 3 is a cross-sectional view showing the interior of the duct 14 of the waste toner transporting mechanism when a side door 38 has been closed.

The duct 14 includes a vertical portion 15 that has a rectangular cross section and extends downward, and a horizontal portion 16 that communicates with the vertical portion 14 and extends in a horizontal direction. The residual toner 41 is adhering to the inner wall of the vertical portion 15. There is provided an agitator 71 in the duct 14. The agitator 71 is fixed at its upper end by an adhesive 73 to the inner wall of the vertical portion 15. The operation of the agitator 71 will be described later in detail. The horizontal portion 16 has a short cylindrical downward projection 37 that projects downward from a lower circumferential wall of the horizontal portion 16. The projection 37 defines a toner exit 34. The chassis supports the vertical and horizontal portions 15 and 16 of the duct 14.

The horizontal portion 16 has a fixed cylinder 19 therein that is fixedly formed on the inner wall of the horizontal portion 16 and coaxially aligned with the horizontal portion 16. There is a cylindrical gap between the fixed cylinder 19 and the horizontal portion 16. A compression spring 20*a* is inserted in the cylindrical gap. A movable cylinder 20 enters the cylindrical gap to slidably fit over the fixed cylinder 19 and abuts the spring 20*a*. The fixed cylinder 19 is formed with an opening 21 in its lower wall and the movable cylinder 20 is formed with an opening 25 in its lower wall. The opening 21 of the fixed cylinder 19 is aligned with the opening 34 defined by the cylindrical projection 37 of the horizontal portion 16. The cylindrical projection 37 fits into a waste-toner reservoir 36 into which the waste toner is finally collected. When the movable cylinder 20 fully enters the cylindrical gap against the urging force of the spring 20*a* to a toner discharging position, the openings 21, 25, and 34 are aligned with one another, thereby allowing communication between the waste-toner reservoir 36 and the horizontal portion 16.

There is provided a space 24 in the horizontal portion 16 in which the movable cylinder 20 is movable back and forth in directions shown by arrows A and B. The movable cylinder 20 is urged by the spring 20*a* in the direction shown by arrow B. When the side door 38 of the image-recording apparatus is closed, a projection 39 formed on the side door 38 enters the horizontal portion 16 through a slit 40 (FIG. 2) formed in the horizontal portion 16. Then, the projection 39 engages the longitudinal end 28 of the movable cylinder 20 and pushes the movable cylinder 20 in the direction shown by arrow A so that the movable cylinder 20 fully fits over the fixed cylinder 19.

A screw conveyor 17 has a shaft 18 and extends in the fixed cylinder 19. The shaft 18 is rotatably supported by an end wall of the horizontal portion 16. The shaft 18 extends outwardly of the duct 14. A gear 29 is attached to the shaft 18 and is in mesh with a gear 33 of the transfer roller 4 via gears 32, 31, and 30 (FIG. 2). Thus, the screw conveyor 17 rotates in synchronism with the transfer roller 4, thereby conveying the waste toner to the opening 21. A lower end portion 74 of the agitator 71 extends into a gap between adjacent blades of the screw conveyor 17.

Figure 4:
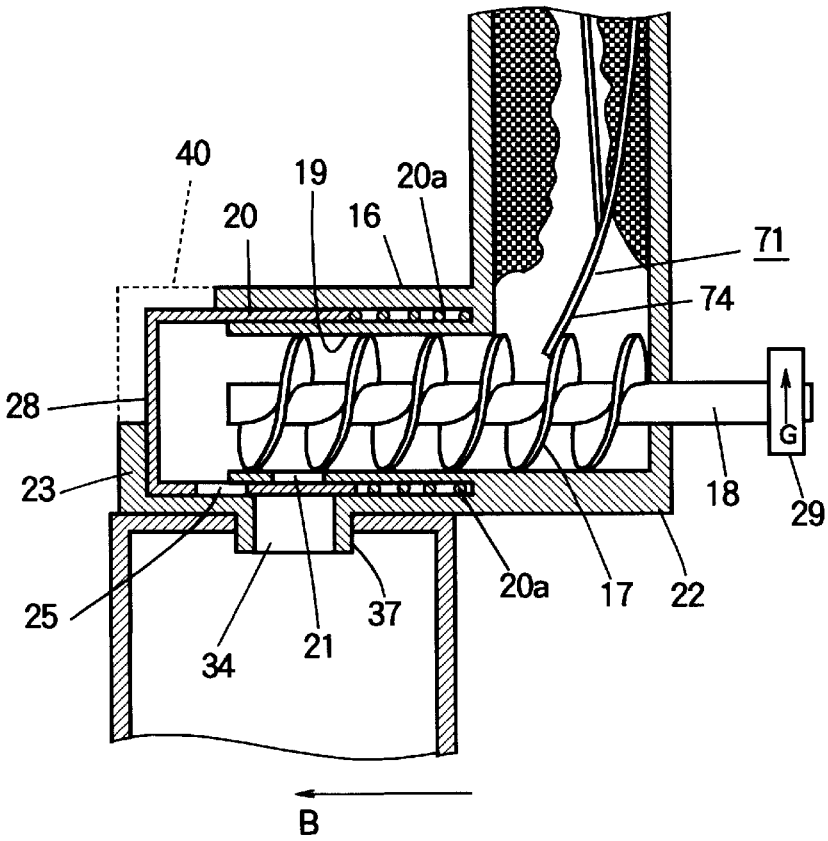

FIG. 4 is a cross-sectional view showing the interior of the horizontal portion 16 when the side door 38 has been opened.

When the side door 38 is opened, the projection 39 moves out of the slits 40 so that the urging force of the spring 20*a* moves the movable cylinder 20 fully in the direction shown by arrow B to a toner non-discharging position. Thus, the opening 25 of the movable cylinder 20 is no longer aligned with the opening 21 of the fixed cylinder 19, the wall of the movable member 20 closing the opening 34. As described above, the movable cylinder 20 serves as a shutter that closes and opens the opening 34.

<Transport of waste toner>

The transport of the waste toner will be described.

Referring back to FIG. 1, the cleaning blade 9 scratches the residual toner off the photoconductive drum 3 after the transfer operation. Then, the residual toner falls into the waste toner-transporting path 8. The screw conveyor 10 rotates in a direction shown by arrow E to transport the waste toner 41 in the direction shown by arrow B (FIG. 2).

Referring back to FIG. 3, the residual toner then falls through the exit 13 into the vertical portion 15 of the duct 14, some of the toner adhering to the inner wall of the vertical portion 15. The screw conveyor 17 is rotating in the direction shown by arrow G and pushes the waste toner 41 on the lower wall of the horizontal portion 16 to the opening 21 in the direction shown by arrow B.

Then, the waste toner 41 falls through the opening 21 into the waste toner reservoir 36.

Referring back to FIG. 4, when the side door 38 is opened, the projection 39 moves out of the slit 40 in the horizontal portion 16, so that the movable cylinder 20 is moved by the spring 20*a* in the direction shown by arrow B to close the opening 34.

Since the opening 34 is closed, the waste toner in the fixed cylinder 19 will not fall through the opening 34 and the waste toner reservoir 36 can be taken out and emptied of the toner therein.

After the waste toner reservoir 36 is emptied of the toner, the waste toner reservoir 36 is replaced to the cylindrical projection 37 of the horizontal portion 16. Upon closing the side door 38, the projection 39 enters the slit 40 to push the movable cylinder 20 at the end wall 28 thereof, so that the movable cylinder 20 moves to the position shown in FIG. 3 against the urging force of the spring 20*a*. Thus, the opening 25 of the movable cylinder 20 becomes aligned with the opening 21 of the fixed cylinder 19.

<Agitator>

Figure 5:
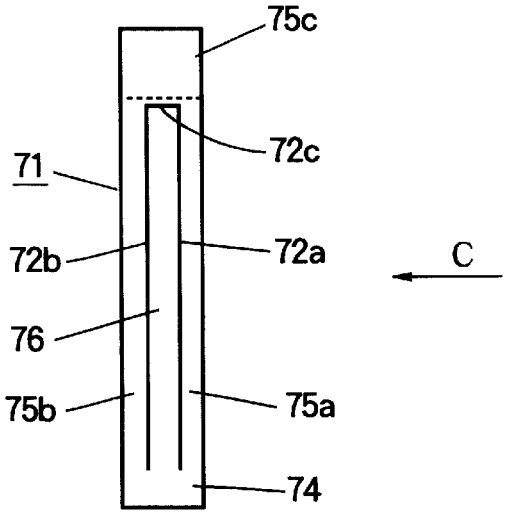
FIG. 5 is a front view of the agitator.
Figure 6:
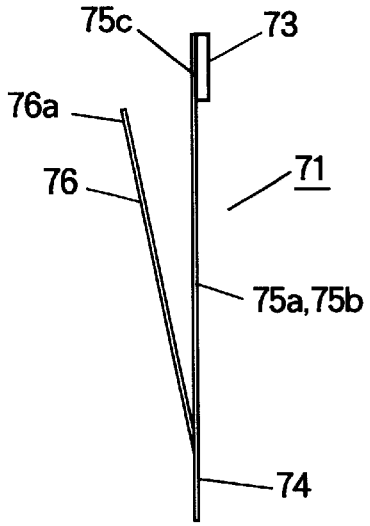
FIG. 6 is a side view of the agitator of FIG. 5 as seen in a direction shown by arrow C.

FIG. 5 is a front view of the agitator 71 and FIG. 6 is a side view of the agitator 71 of FIG. 5 as seen in a direction shown by arrow C of FIG. 5.

The agitator 71 is generally a long rectangular sheet made of synthetic resin film having resiliency, for example, a film of polyester. The agitator 71 has a long strap-like middle portion 76 and side portions 75*a* and 75*b*. As shown in FIG. 5, the agitator 71 has, for example, incisions 72*a*, 72*b*, and 72*c* therein that form a long rectangular middle portion 76 flexing away from the side portions 75*a* and 75*b*. The long middle portion 76 and the side portions 75*a* and 76*b* are sufficiently resilient. An upper end portion 75*c* is fixed by an adhesive 73 to the inner wall of the vertical portion 15 of the duct 14.

<Operation>

The waste toner collecting operation of the aforementioned construction of the first embodiment will be described.

Referring to FIGS. 1, 2 and 3, after the transfer operation, the residual toner on the photoconductive drum 3 is scratched off the surface of the photoconductive drum 3. The waste toner 41 falls through the opening 13 into the duct 14. The shaft 18 of the screw conveyor 17 rotates in the direction shown by arrow G so that the screw conveyor 17 rotates about the shaft 18.

Figure 7:
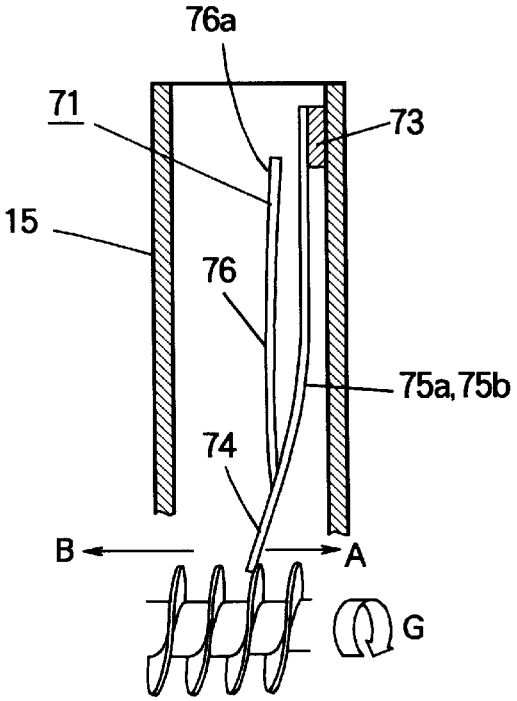
FIGS. 7 and 8 illustrate the agitator that engages the coil spring when the coil spring rotates.
Figure 8:
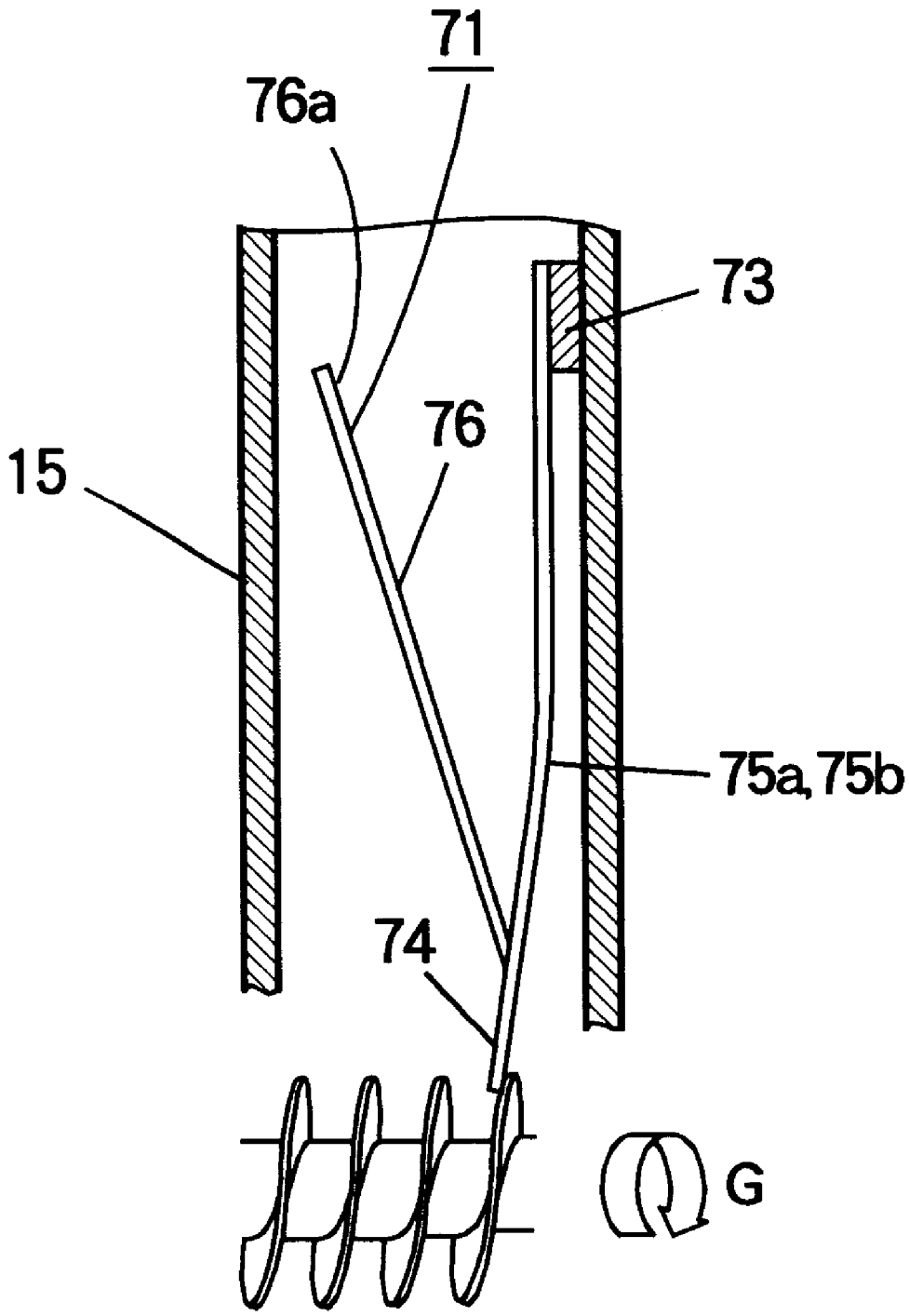

FIGS. 7 and 8 illustrate the agitator 71 that engages the screw conveyor 17 when the screw conveyor 17 rotates.

Referring to FIG. 7, when the screw conveyor 17 rotates in the direction shown by arrow G, the point at which the lower end portion 74 of the agitator 71 engages a blade of the screw conveyor 17 moves in the direction shown by arrow B. Thus, the lower end portion 74 slides on the blade and is pushed to gradually move in the direction shown by arrow B. Therefore, the agitator 71 is resiliently deformed such that the lower end portion 74 flexes away from the vertical inner wall of the vertical portion 15 of the duct 14.

When the lower end portion 74 fully flexes away from the vertical inner wall, the free end 76*a* of the middle portion 76 approaches the inner wall of the vertical portion 15. When the screw conveyor 17 continues to further rotate, the lower end portion 74 will finally snaps out of engagement with the blade of the screw conveyor 17. The lower end portion 74 resiliently moves in the direction shown by arrow A, returning to its original position shown in FIG. 8 where the lower end portion 74 extends into a gap between the next adjacent blades of the screw conveyor 17. As a result, the free end 76*a* of the middle portion 76 returns to its original position where the fee end 76*a* is close to the opposite inner wall of the vertical portion 15.

The screw conveyor 17 continues to rotate, so that the lower end portion 74 is again pushed by the blade of the screw conveyor 17 to flex in the direction shown by arrow B. As a result, the free end 76*a* of the middle portion 76 moves toward the inner wall of the vertical portion 15. Thereafter, the lower end portion 74 fully flexes and then snaps out of engagement with the blade of the screw conveyor 17. The lower end portion 74 of the agitator 71 repeats the aforementioned swinging motion as long as the screw conveyor continues to rotate. As a result, the free end 76*a* of the middle portion 76 rapidly swings many times between opposing inner walls, eventually returning to one of the opposing inner walls of the vertical portion 15. The vibration of the middle portion 76 applies mechanical vibration to the residual toner 41 adhering to the inner wall of the vertical portion 15, so that the residual toner 41 falls from the inner wall.

The screw conveyor 17 sweeps the waste toner 41 at the bottom of the vertical portion 15 to the opening 21 formed in the fixed cylinder 19. Since the movable cylinder 20 is at the toner discharging position (FIG. 3), the waste toner 41 falls through the openings 21, 25, and 34 into the waste toner reservoir 36.

Second embodiment

The overall construction of an image-forming apparatus according to a second embodiment is substantially the same as that of the first embodiment. The second embodiment differs from the first embodiment in that a coil spring 53 is used in place of the spring 20*a* and the screw conveyor 17. When the coil spring rotates about its longitudinal axis, turns of the coil spring 53 effectively serve as "a screw blade" that transports toner.

Figure 9:
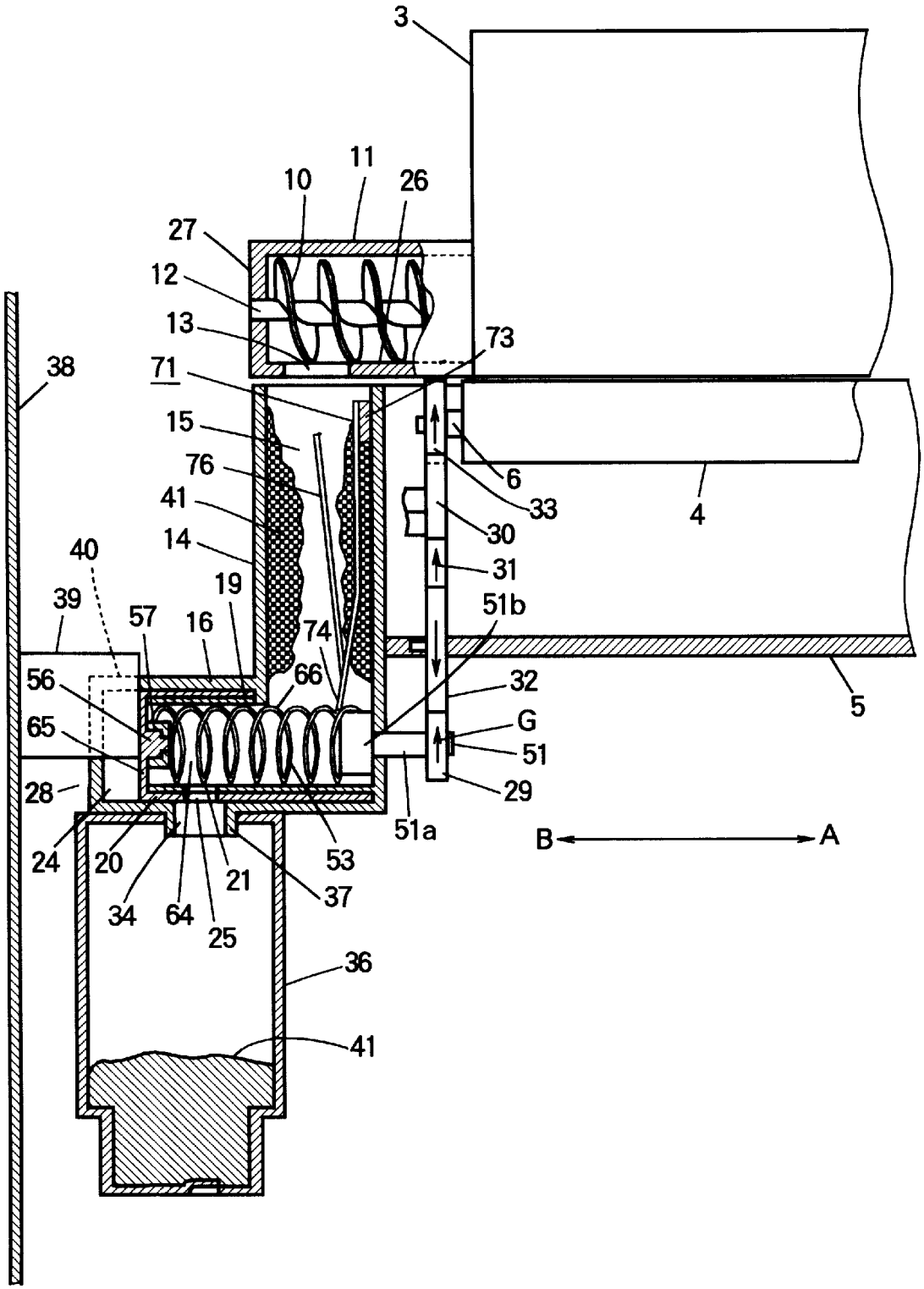
FIG. 9 is a cross-sectional view of the interior of the duct according to a first embodiment, through which waste toner is transported.

FIG. 9 is a cross-sectional view showing the interior of the duct 14 of the waste toner transporting mechanism according to the second embodiment. FIG. 9 illustrates the movable cylinder is at the toner discharging position.

Figure 15:
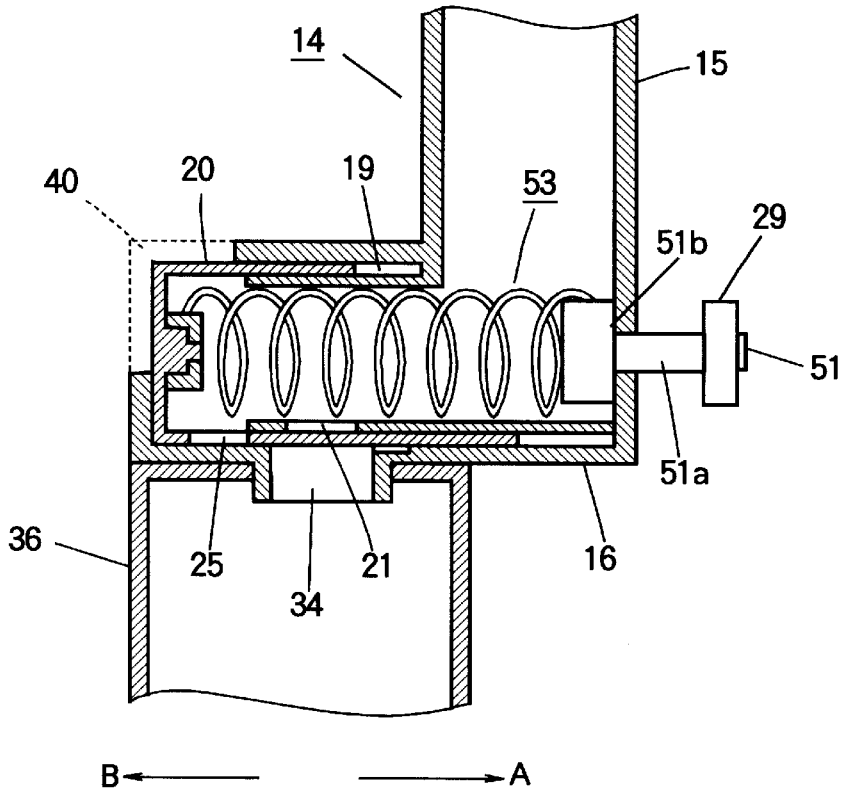
FIG. 15 illustrates the movable cylinder at the toner non-discharging position.

Referring to FIG. 9, the horizontal portion 16 of the duct 14 has a fixed cylinder 19 therein that is fixedly formed on the inner wall of the horizontal portion 16 and coaxially aligned with the horizontal portion 16. There is a cylindrical gap between the fixed cylinder 19 and the horizontal portion 16. A movable cylinder 20 has an opening 25 formed in its lower wall and enters the cylindrical gap to slidably fit over the fixed cylinder 19. The movable cylinder 20 is slidable in the directions shown by arrows A and B between the toner discharging position (FIG. 9) and the toner non-discharging position (FIG. 15). In other words, the movable cylinder 20 serves as a shutter that closes and opens the opening 34.

When the side door 38 is closed, the projection 39 formed on the side door 38 pushes the end wall 65 of the movable cylinder 20 fully in the direction shown by arrow A to the toner discharging position. As a result the opening 25 is aligned with the opening 34 of the waste toner reservoir 36. Thus, the vertical portion 15, horizontal portion 16, and waste toner reservoir 36 are communicated with one another.

A shaft 51 includes a small diameter portion 51*a* and a large diameter portion 51*b*. The large diameter portion 51*b* projects into the fixed cylinder 19 and the small diameter portion 51*a* projects outwardly of the duct 14. The small diameter portion 51*a* has a gear 29 coaxially attached thereto and is rotatably supported by the wall of the duct 14. The coil spring 53 extends through the fixed cylinder 19. While rotating, turns 66 of the coil spring 53 slide on the inner wall of the fixed cylinder 19.

One end of the coil spring 53 firmly fits over the large diameter portion 51*b* and the other end of the coil spring 53 is connected to a cap 57. The coil spring 53 urges the movable cylinder 20 in the direction shown by arrow B.

The cap 57 slidably fits over the inner projection 56 of a longitudinal end wall 65 of the movable cylinder 20. The inner projection 56 has a narrow short projection 58 (FIG. 11) formed at the top thereof so that the cap 57 smoothly rotates together with the spring 53 about the pin 58 and the inner projection 56.

Figure 10:
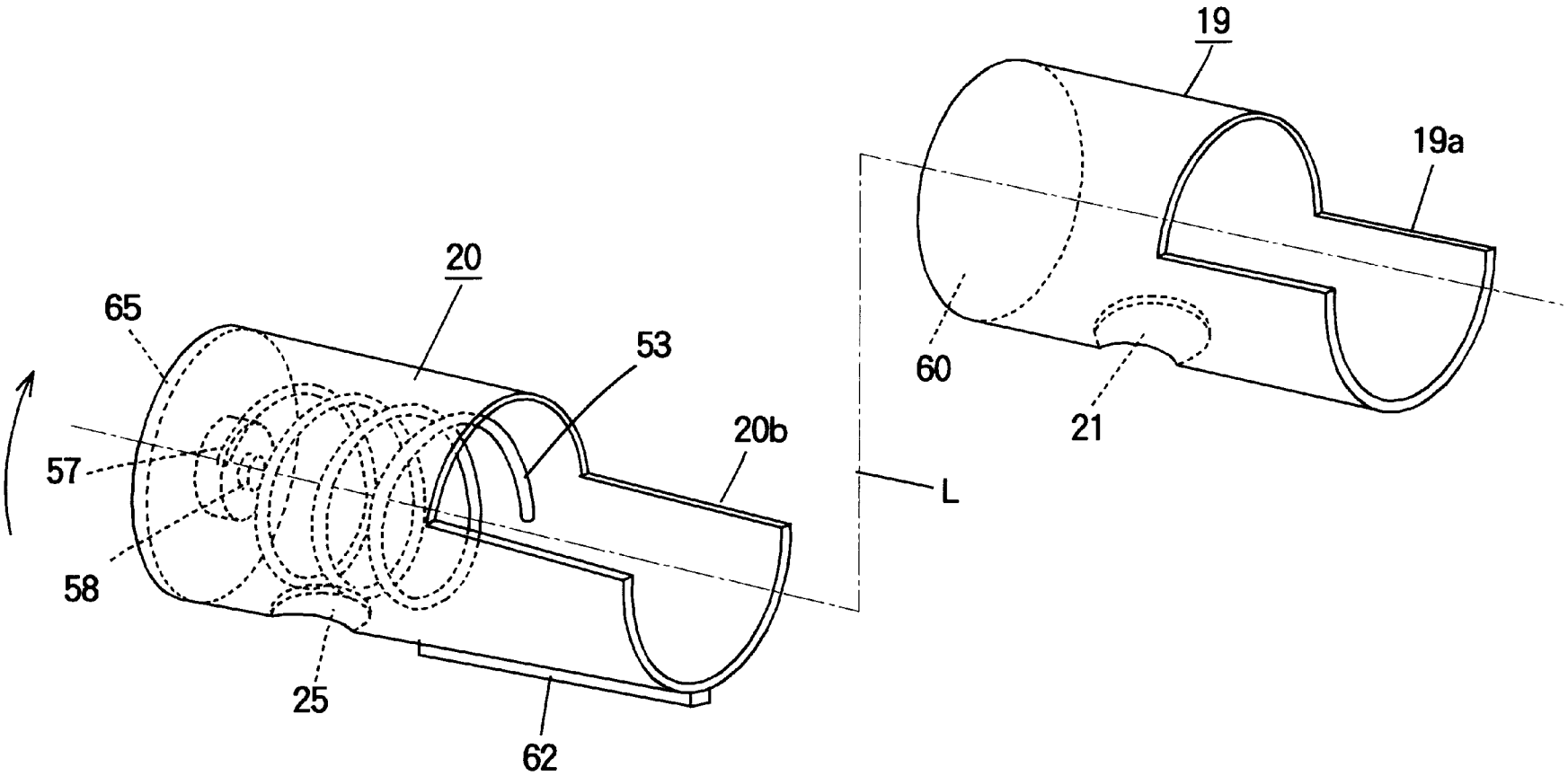
FIG. 10 is a perspective view of the fixed cylinder and the movable cylinder.

FIG. 10 is a perspective view of the fixed cylinder 19 and the movable cylinder 20.

The fixed cylinder 19 and the movable cylinder 20 have cut away portions 19*a* and 20*b* at their upper half portions, respectively, substantially aligned with each other such that the interior of the fixed cylinder 19 communicates with the vertical portion 15 through the cut away portions 19*a* and 20*b*. The fixed cylinder 19 is formed with an opening 21 in its lower wall and the movable cylinder 20 is formed with an opening 25 in its lower wall. The opening 21 of the fixed cylinder 19 is aligned with the opening 34 defined by a cylindrical projection 37 of the horizontal portion 16.

Figure 11:
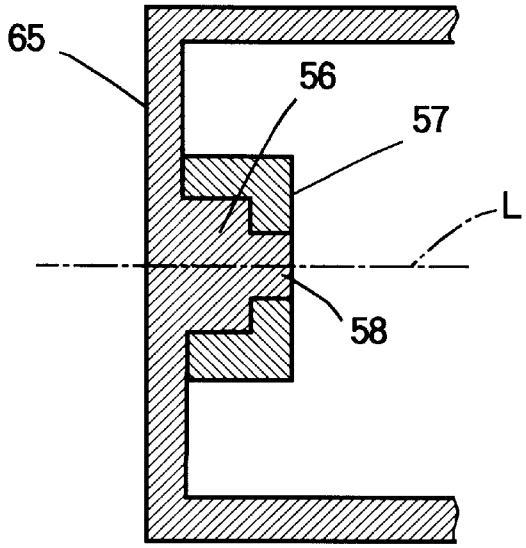
FIG. 11 is a fragmentary cross-sectional view of an end portion of the movable cylinder.

FIG. 11 is a fragmentary cross-sectional side view of an end portion of the movable cylinder 20.

Referring to FIG. 11, a cap 57 is securely connected to the spring 53 and rotatably fits over the inner projection 56. The inner projection 56 has a narrow projection 58 that serves a rotary axis around which the cap 57 rotates.

The movable cylinder 20 has a guide rib 62 on an outer surface of the movable cylinder 20. The guide rib 62 extends along the longitudinal direction of the movable cylinder 20 and is slidably received in a guide groove, not shown, formed in an inner surface of the horizontal portion 16. Thus, the movable cylinder 20 is only slidable in the directions shown by arrows A and B and not rotatable relative to the horizontal portion 16.

Figure 12:
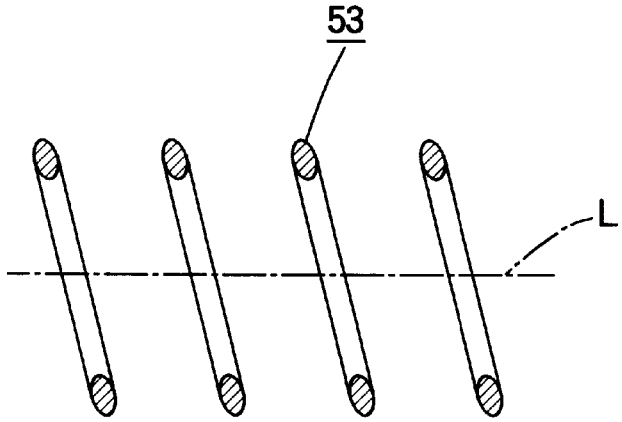
FIG. 12 illustrates a modification of the coil spring.

FIG. 12 illustrates a modification of the coil spring 53.

While the coil spring 53 has a circular cross section, it may be other shape such as an elongated circle as shown in FIG. 12. The elongated circular cross section is more effective in transporting waste toner since the coil serves more like a screw conveyor.

FIG. 15 illustrates the movable cylinder 20 when the movable cylinder 20 is at a toner non-discharging position.

When the side door 38 is opened, the projection 39 moves out of the slit 40 formed in the horizontal portion 16, so that the coil spring 53 pushes the movable cylinder 20 fully in the direction shown by arrow B to the toner non-discharging position. Thus, the lower wall of the movable cylinder 20 completely closes the opening 34 so that there is no possibility of the waste toner falling from the horizontal portion 16. Thus, the waste toner reservoir 36 can be disconnected from the cylindrical projection 37 of the horizontal portion 16 and taken out of the image forming apparatus. After the waste toner reservoir 36 has been emptied of the residual toner, the waste toner reservoir 36 is replaced into the image forming apparatus such that the waste toner reservoir 36 again fits over the cylindrical projection 37. Then, when the side door 38 is closed again, the projection 39 again enters the slit 40 to push the movable cylinder 20 against the urging force of the coil spring 53 until the movable cylinder 20 is again at the toner discharging position.

<Operation of agitator>

Figure 13:
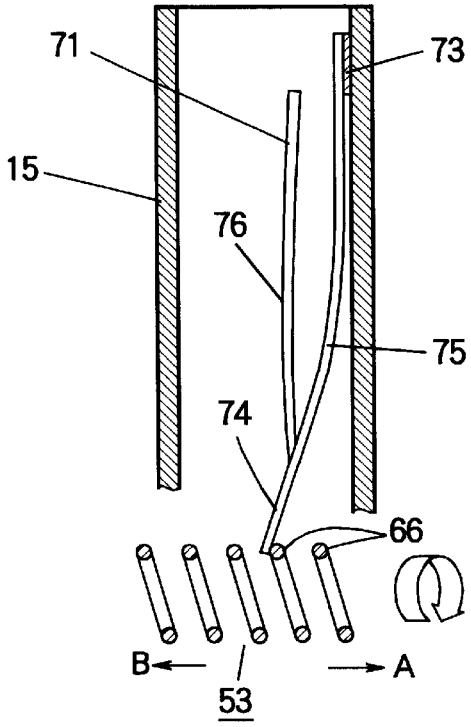
FIGS. 13 and 14 illustrate the agitator that engages the coil spring when the coil spring rotates.
Figure 14:
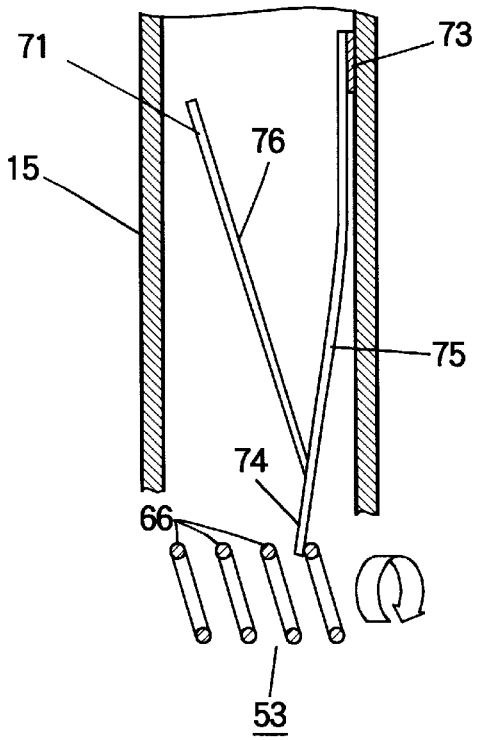

FIGS. 13 and 14 illustrate the agitator 71 that engages the coil spring 53 when the coil spring 53 rotates.

Referring to FIG. 13, when the coil spring 53 rotates in the direction shown by arrow G, the point at which the lower end portion 74 of the agitator 71 engages a turn 66 of the coil spring 53 moves in the direction shown by arrow B. Thus, the lower end portion 74 is pushed to move in the direction shown by arrow B. Therefore, the agitator 71 is deformed such that the lower end portion 74 flexes away from the inner wall of the vertical portion 15 of the duct 14.

When the lower end portion 74 fully flexes away from the inner wall, the free end 76*a* of the middle portion 76 of the agitator 71 approaches the inner wall of the vertical portion 15. Further rotation of the coil spring 53 causes the lower end portion 74 to finally snap out of engagement with the turn 66 of the coil spring 53. The lower end portion 74 quickly moves in the direction shown by arrow A, returning to its original position shown in FIG. 14 where the lower end portion 74 extends into a gap between the next adjacent turns 66 of the coil spring 53. The free end 76*a* of the middle portion 76 is now close to the inner wall of the vertical portion 15 of the duct 14.

The coil spring 53 continues to rotate, so that the turn 66 of the coil spring 53 again pushes the lower end portion 74 in the direction shown by arrow B. As a result, the free end 76*a* of the middle portion 76 moves to the inner wall of the vertical portion 15. Thereafter, the lower end portion 74 fully flexes and then snaps out of engagement with the turn 66 of the coil spring 53. The lower end portion 74 of the agitator 71 repeats the aforementioned swinging motion as long as the coil spring 53 continues to rotate.

The coil spring 53 sweeps the waste toner 41 that has fallen onto the bottom of the vertical portion 15 to the opening 21 formed in the fixed cylinder 19. Since the movable cylinder 20 is at the toner discharging position (FIG. 9), the waste toner 41 falls through the openings 21, 25, and 34 into the waste toner reservoir 36.

Third embodiment

A third embodiment differs from the second embodiment in that a toner receiver 50 is used in place of the fixed cylinder 19.

Figure 16:
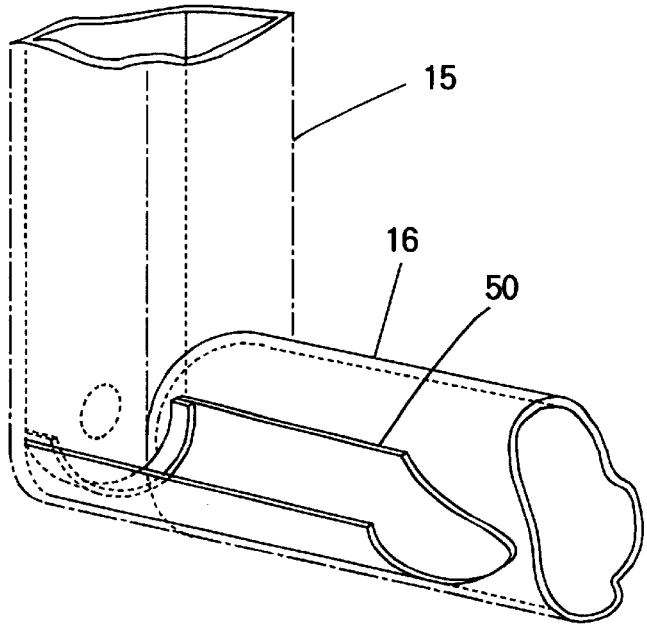
FIG. 16 is a fragmentary perspective view of the toner receiver and its surroundings.

FIG. 16 is a fragmentary perspective view of the toner receiver 50 and its surroundings.

The toner receiver 50 is a thin sheet of a plastic film having a substantially semicircular cross section. When the coil spring 53 rotates, the coil spring 53 slides on the toner receiver 50 to sweep the waste toner, which has fallen onto the toner receiver 50, to the opening 25.

Figure 17:
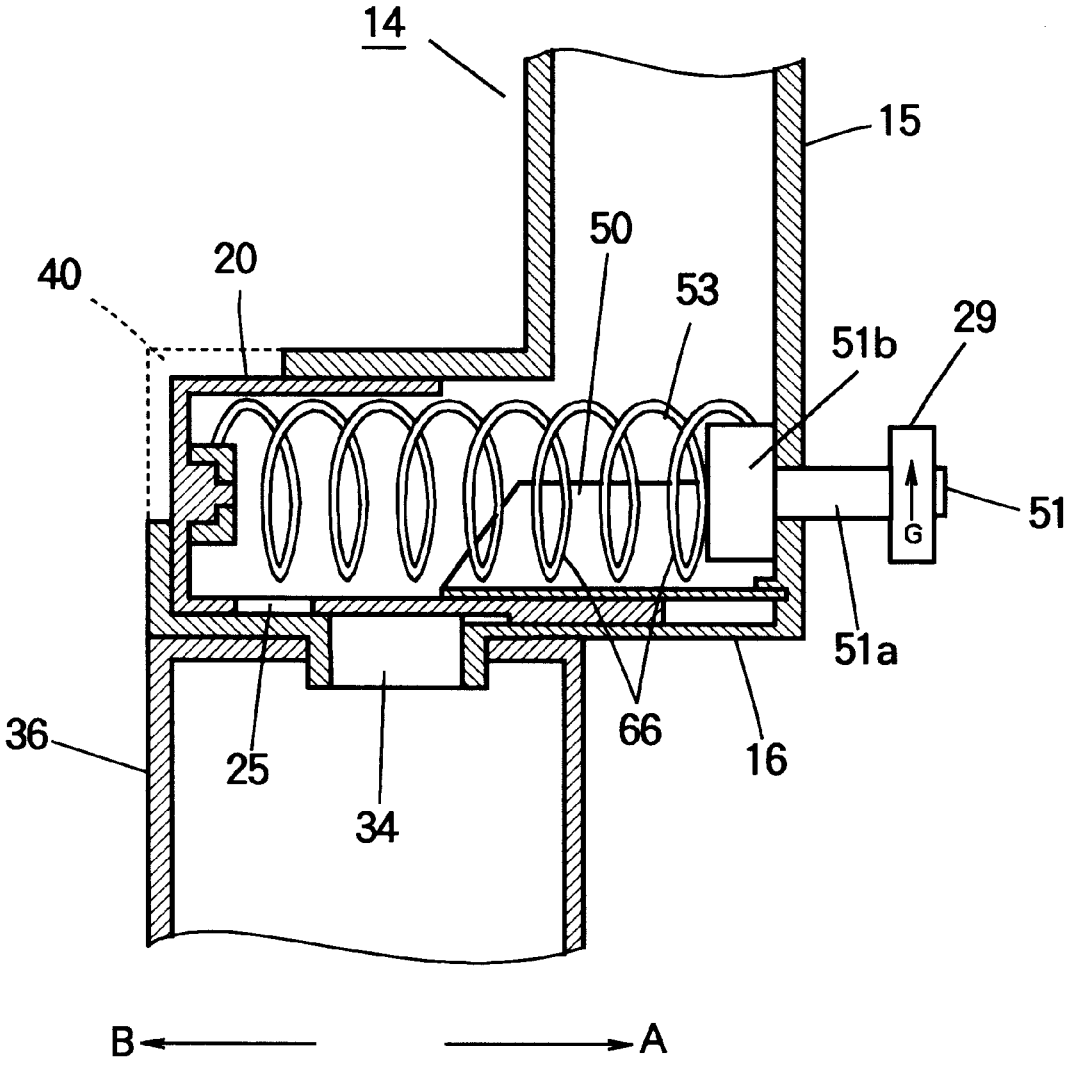
FIG. 17 is a fragmentary cross-sectional view of the horizontal portion of the duct when the movable cylinder is at the toner non-discharging position.

FIG. 17 is a fragmentary cross-sectional view of the horizontal portion 16 of the duct 14 when the movable cylinder 20 is at the toner non-discharging position.

Referring to FIG. 17, when the side door 38 is opened, the coil spring 53 pushes the movable cylinder 20 fully in the direction shown by arrow B to the toner non-discharging position where the opening 25 is not aligned with the opening 34 of the waste toner reservoir 36. When the gear 29 rotates in the direction shown by arrow G, the coil spring 53 rotates so that the turns 66 of the coil spring 53 slides on the sheet 50. The toner receiver 50 prevents the toner falling through the vertical portion 15 from entering a space which is formed between the vertical wall of the horizontal portion 16 and the movable cylinder 20 when the movable cylinder 20 is at the toner non-discharging position.

Figure 18:
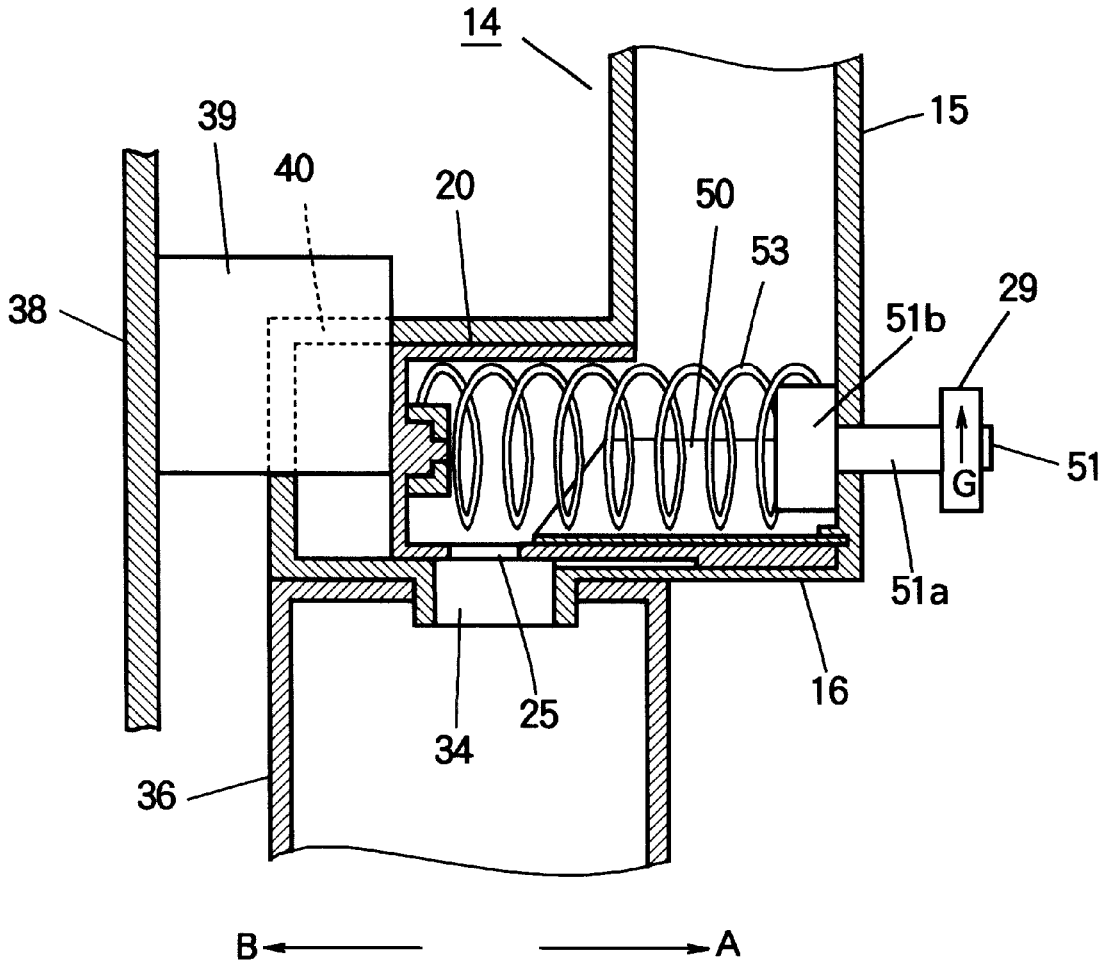
FIG. 18 is a fragmentary cross-sectional view of the horizontal portion of the duct when the movable cylinder is at the toner discharging position.

FIG. 18 is a fragmentary cross-sectional view of the horizontal portion 16 of the duct 14 when the movable cylinder 20 is at the toner discharging position.

When the side door 38 has been closed, the projection 39 pushes the movable cylinder 20 in the direction shown by arrow A to the toner discharging position as shown in FIG. 18 where the opening 25 is aligned with the opening 34 of the waste toner reservoir 36.

<Modification of agitator>

Figure 19:
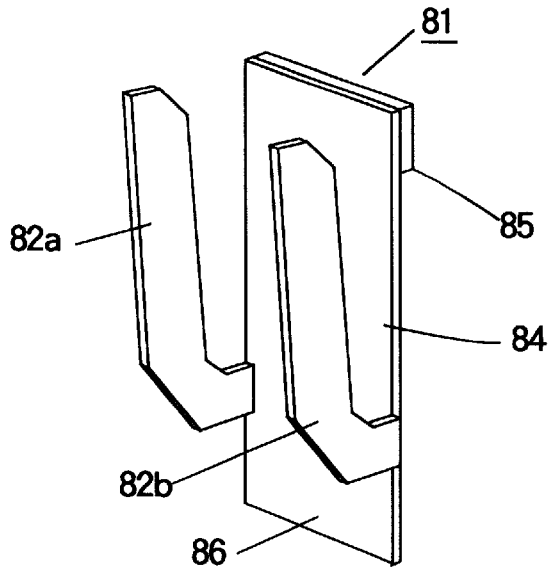
FIG. 19 is a perspective view of an agitator, which is a modification of the agitator.

FIG. 19 is a perspective view of an agitator 81, which is a modification of the agitator 71.

The agitator 81 is a film of a synthetic resin having resiliency, such as a polyester film. The agitator 81 includes a long, resilient rectangular main body 84 and a pair of flat straps 82*a* and 82*b* that extend in planes substantially perpendicular to the main body 84.

An upper end portion of the agitator 81 is bonded by an adhesive 85 to the inner wall of the vertical portion 15 of the duct 14. A lower end portion 86 engages the turns 66 of the coil spring 53 in the same way as the lower end portion 74 of the agitator 71.

Figure 20:
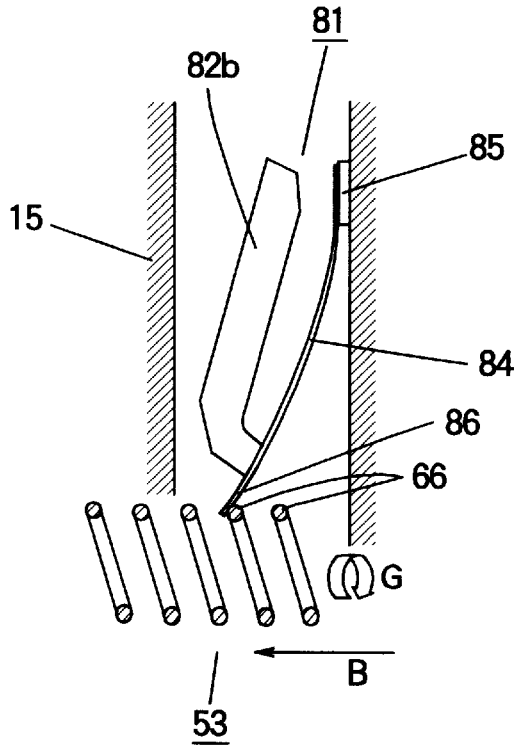
FIGS. 20 and 21 illustrate the movement of the agitator when it is assembled to the inner wall of the vertical portion of the duct.
Figure 21:
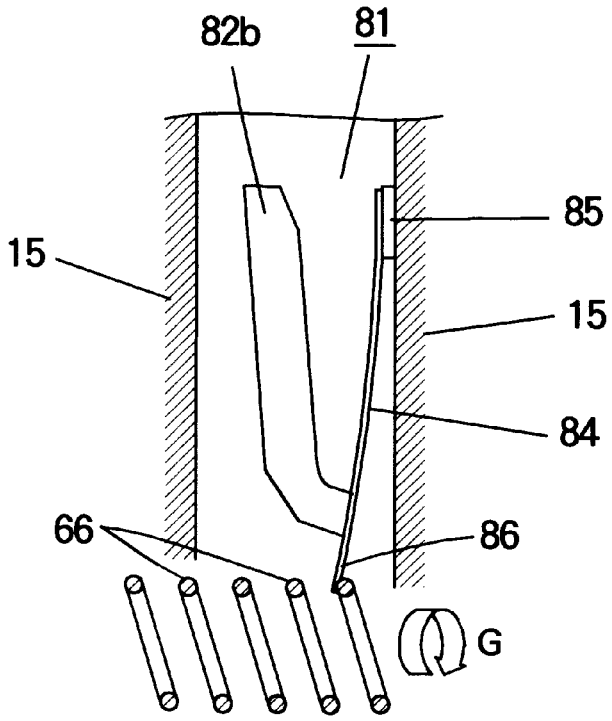

FIGS. 20 and 21 illustrate the movement of the agitator 81 after it has been assembled to the inner wall of the vertical portion 15 of the duct 14. When the main body 84 is least deformed, the free ends of the straps 82*a* and 82*b* are close to the inner wall of the vertical portion 15. As the coil spring 53 rotates, the lower end portion 86 of the main body 84 fully flexes in the direction shown by arrow B and the free ends approaches the opposite inner wall as shown in FIG. 20 and then returns to its original position as shown in FIG. 21 after it has fully flexed.

The agitator 81 repeats snapping motion as the coil spring 53 rotates, so that the straps 82*a* and 82*b* agitate the waste toner 41 that tends to adhere to the inner wall of the vertical portion 15 of the duct 14. The straps 82*a* and 82*b* are subjected to dampened oscillation in directions substantially perpendicular to the planes in which the straps 82 extend.

Figure 22:
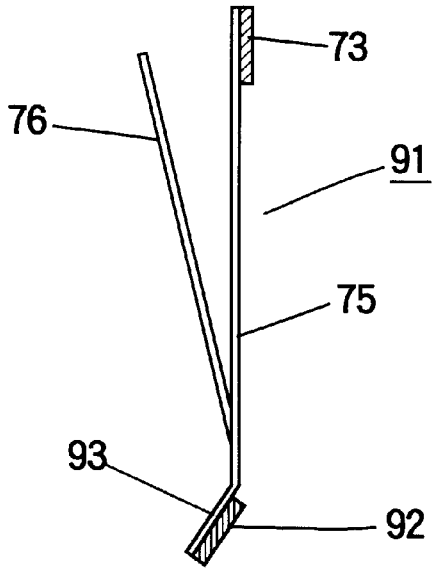
FIG. 22 illustrates an agitator, another modification of the agitator.

FIG. 22 illustrates an agitator 91, which is another modification of the agitator 71.

Figure 23:
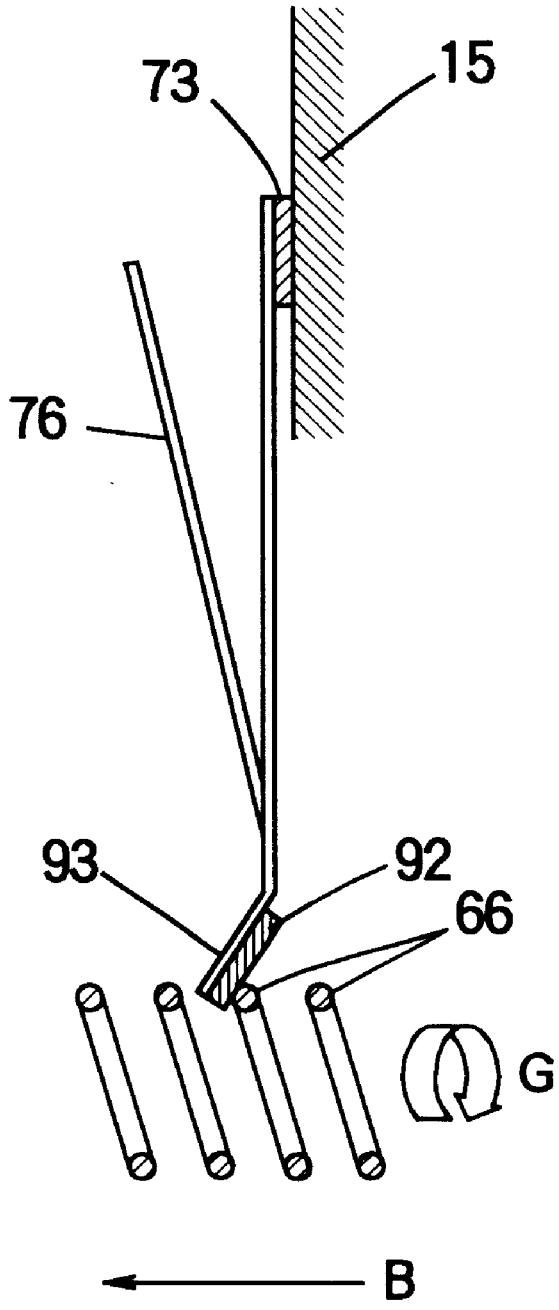
FIG. 23 illustrates the agitator when it engages the coil spring.

FIG. 23 illustrates the agitator 91 when it engages the coil spring 53.

The agitator 91 differs from the agitator 71 of FIGS. 5 and 6 in that a lower end portion 93 has a friction member 92 attached thereto. The friction member 92 engages the turns 66 of the coil spring 53 as shown in FIG. 23, so that as the coil spring 53 rotates, the contact point at which the friction member 92 engages a turn 66 of the coil spring 53 moves in the direction shown by arrow B. The friction member 92 slides on the turns 66 with large friction. The large friction prevents the friction member 92 from smoothly sliding on the turns 66 of the coil spring 53 but causes fine vibration of the friction member 92 on the turn 66 of the coil spring 53. The fine vibration of the friction member 92 is transmitted to the middle portion 76 which is then subjected to vibration.

The fine vibration of the middle portion 76 ensures smooth falling of the waste toner 41 through the vertical portion 15 of the duct 14, thereby effectively preventing toner from clumping.

The aforementioned embodiment have been described with respect to the agitator made of polyester film, the agitator can be of other materials such as metal.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image forming apparatus having a waste toner transporting path that includes a first path through which the waste toner falls due to its weight and a second path into which the waste toner falls, the image forming apparatus comprising:

a spiral member axially extending in the second path, the spiral member rotating to transport the waste toner along the second path; and a resilient agitator having a resilient main body, a first end portion, a second end portion, and an agitating strap that resiliently extends away from the main body, the first end portion being fixedly attached to an inner wall of the first path, the second end portion slidingly engaging the spiral member;

wherein when the spiral member rotates, second end portion moves along the second path so that the agitating strap reciprocates in the first path.

2. The image forming apparatus according to claim 1, wherein the resilient agitator is a substantially rectangular synthetic film and has an incision to define the agitating strap.

3. The image forming apparatus according to claim 1, wherein the resilient agitator is a substantially rectangular synthetic film and has a pair of flaps that extends at an angle with the main body.

4. The image forming apparatus according to claim 1, wherein the resilient agitator has a friction member attached to the second end portion so that the friction member engages the spiral member;

wherein when the spiral member rotates, the friction between the friction member and the spiral member causes vibration of the agitating strap.

5. The image forming apparatus according to claim 1, wherein said spiral member is a screw conveyor.

6. The image forming apparatus according to claim 1, wherein said spiral member is a coil spring.

7. The image forming apparatus according to claim 1, wherein when the spiral member rotates, the spiral member slidingly engages the second end portion to cause the second end portion to move along the second path so that the second end portion finally snaps out of engagement with the spiral member;

wherein after the second end portion snaps out of engagement with the spiral member, the second end portion resiliently returns to its original position so that the spiral member again slidingly engages the second end portion as the spiral member rotates.

8. An image forming apparatus, comprising:

a path through which toner is transported, said path having an opening formed therein through which the toner is discharged from said path;

a shutter movable in said path between a closing position and an opening position, said shutter closing the opening when said shutter is at the closing position and opening the opening when said shutter is at the opening position;

a coil spring that axially extends in said path, said coil spring transporting the toner to the opening when the coil spring is rotated about an axis thereof, said coil spring urging said shutter toward the closing position; and an engagement member that is operatively connected to a door, said engagement member engaging said shutter to move said shutter against an urging force of said coil spring to the opening position when the door is closed, and disengaging from said shutter to allow said shutter to move to the closing position.

9. The image forming apparatus according to claim 8, further comprising a thin film that has a substantially semi-circular cross section and extends in said path;

wherein said film covers a space that is formed between said shutter and a vertical wall of said path when said shutter is at the closing position.

* * * * *